US007718879B2

(12) United States Patent
Takemori

(10) Patent No.: US 7,718,879 B2
(45) Date of Patent: May 18, 2010

(54) HAMMER SHANK OF PIANO AND METHOD OF MANUFACTURING THE SAME

(75) Inventor: Go Takemori, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 12/270,484

(22) Filed: Nov. 13, 2008

(65) Prior Publication Data

US 2009/0120265 A1 May 14, 2009

(30) Foreign Application Priority Data

Nov. 14, 2007 (JP) ..... 2007-295513

(51) Int. Cl.
*G10D 13/02* (2006.01)

(52) U.S. Cl. ..... 84/423 R

(58) Field of Classification Search ..... 84/423 R, 84/433, 173, 174, 236–241, 248, 250
See application file for complete search history.

(56) References Cited

FOREIGN PATENT DOCUMENTS

| | | | |
|---|---|---|---|
| JP | 2005-077455 | | 3/2005 |
| JP | 2008102253 A | * | 5/2008 |
| JP | 2008242427 A | * | 10/2008 |

* cited by examiner

*Primary Examiner*—Kimberly R Lockett
(74) *Attorney, Agent, or Firm*—Crowell & Moring LLP

(57) ABSTRACT

There is provided a hammer shank for a piano which is capable of suppressing a change in the dimension between two arms due to dryness and wetness to thereby ensure smooth and stable operation of a hammer. A hammer shank is supported by a flange and pivotally moves in accordance with key depression. A shank body formed of wood has two bifurcated arms formed on one end thereof. These arms extend in facing and parallel relation to each other along respective opposite sides of the flange, and are pivotally supported by the flange. Phenol backers are attached on outer side surfaces of the respective two arms so as to prevent the two arms from being displaced in a direction in which they face each other.

5 Claims, 5 Drawing Sheets

EMBODIMENT

AFTER HUMIDIFICATION

AFTER DRYING

FIG. 6A (1) NORMAL CONDITIONS→HUMIDIFICATION→DRYING

| | ARM-TO-ARM DIMENSION W(mm) | | | DIFFERENCE IN DIMENSION(mm) | |
|---|---|---|---|---|---|
| | NORMAL | AFTER HUMIDIFICATION | AFTER DRYING | BEFORE AND AFTER HUMIDIFICATION | BEFORE AND AFTER DRYING |
| PRIOR ART | 6.47 (0.02) | 6.60 (0.03) | 6.37 (0.04) | 0.13 (0.02) | -0.23 (0.04) |
| EMBODIMENT | 6.43 (0.03) | 6.48 (0.04) | 6.48 (0.04) | 0.05 (0.04) | 0.00 (0.06) |

*PARENTHESIZED VALUE: STANDARD DEVIATION

FIG. 6B (2) NORMAL CONDITIONS→DRYING→HUMIDIFICATION

| | ARM-TO-ARM DIMENSION W(mm) | | | DIFFERENCE IN DIMENSION(mm) | |
|---|---|---|---|---|---|
| | NORMAL | AFTER DRYING | AFTER HUMIDIFICATION | BEFORE AND AFTER DRYING | BEFORE AND AFTER HUMIDIFICATION |
| PRIOR ART | 6.47 (0.02) | 6.36 (0.03) | 6.59 (0.03) | -0.11 (0.02) | 0.23 (0.03) |
| EMBODIMENT | 6.42 (0.02) | 6.40 (0.04) | 6.49 (0.03) | -0.02 (0.03) | 0.09 (0.04) |

*PARENTHESIZED VALUE: STANDARD DEVIATION

HAMMER SHANK OF PIANO AND METHOD OF MANUFACTURING THE SAME

BACKGROUND OF THE INVENTION

1. Field of the Invention

The present invention relates to a hammer shank for a piano, which pivotally moves in accordance with key depression, and a method of manufacturing the same.

2. Description of the Related Art

Conventionally, a hammer of a piano, which has a hammer shank, has been disclosed e.g. in Japanese Laid-Open Patent Publication (Kokai) No. 2005-77455. The hammers are provided in association with respective keys, and each of the hammers is pivotally supported by a hammer shank flange (hereinafter simply referred to as "the shank flange"). Each of the hammers includes a long, slender wooden hammer shank and a hammer head fixed to a rear end of the hammer shank. The hammer shank has a front end thereof bifurcated into two left and right arms extending forward in facing and parallel relation to each other. The shank flange is formed by a synthetic resin molded article, and screwed to a hammer shank rail. The shank flange has a rear end thereof formed with an engaging part projecting rearward, and the two arms of the hammer shank are engaged on the opposite sides of the engaging part. Further, a pin is horizontally passed through the two arms and the engaging part. This pin is rigidly secured to the engaging part, but is supported by the two arms in a pivotally movable manner. Thus, the hammer is pivotally supported by the shank flange via the pin integral with the shank flange. The opposite side surfaces of the engaging part of the shank flange are formed parallel to each other, and each of the side surfaces of the engaging part of the shank flange is opposed to the inner side surface of an associated arm of the hammer shank with a slight clearance.

With the above-mentioned arrangement, as an associated key is depressed, an associated action operates to push up the hammer shank, whereby the hammer pivotally moves upward, and the hammer head strikes an associated string to thereby generate a piano tone. During the pivotal motion of the hammer, the hammer shank is guided by the two arms and the engaging part of the shank flange, so that the hammer can perform the pivotal motion without deflecting laterally.

However, the hammer shank, which is made of wood, is susceptible to a use environment of the piano, particularly to dryness and wetness, and hence there is a fear that smooth and stable pivotal motion of the hammer cannot be obtained due to a change in the dimension between the two arms. Specifically, when the dimension between the arms of the hammer shank is reduced due to shrinkage caused by dryness (see FIG. 5B), the clearances between the two arms and the engaging part is sometimes lost, which causes a defective operation of the hammer, such as incapability of smooth pivotal motion of the hammer (which will be hereinafter referred to as "a stick"). On the other hand, when the dimension between the arms of the hammer shank is increased due to expansion caused by wetness (see FIG. 5A), the clearances between the two arms and the engaging part become larger. As a result, there is a fear that the hammer deflects laterally or wobbles during pivotal motion, thereby hindering the hammer from properly striking the string.

SUMMARY OF THE INVENTION

The present invention has been made in order to solve the above problem, and an object thereof is to provide a hammer shank for a piano, which is capable of suppressing a change in the dimension between two arms due to dryness and wetness to thereby ensure smooth and stable operation of a hammer, and a method of manufacturing the hammer shanks.

To attain the above object, in a first aspect of the present invention, there is provided a hammer shank for a piano, which is supported by a flange and pivotally moves in accordance with key depression, comprising a shank body that is formed of wood, two bifurcated arms that are formed on one end of the shank body in a manner extending in facing and parallel relation to each other along respective opposite sides of the flange, and are pivotally supported by the flange, and displacement suppression members that are attached on outer side surfaces of the respective two arms so as to suppress displacement of the two arms in a direction in which the arms face each other.

With the construction of the hammer shank for a piano according to the first aspect of the present invention, the wooden shank body has the one end bifurcated into the two arms extending in facing and parallel relation to each other along the respective opposite sides of the flange, and the two arms are pivotally supported by the flange. This causes, according to key depression, the hammer shank to perform pivotal motion while being guided by the two arms and the flange. Further, the displacement suppression members are attached on the outer side surfaces of the respective two arms. The displacement suppression members function as splints, so to say, for the respective associated arms to restrain these. As a consequence, displacement of the arms in the direction in which they face each other is suppressed. This makes it possible to stably maintain the dimension between the arms to thereby maintain the size of the clearance between each of the inner side surfaces of the respective arms and the shank flange, so that occurrence of a stick due to dryness and wetness, and lateral deflection and wobbling of the hammer during its pivotal motion can be prevented. Therefore, it is possible to ensure smooth and stable operation of the hammer irrespective of whether it is dry or wet.

Preferably, each of the displacement suppression members is formed of a material containing a predetermined synthetic resin.

In general, a synthetic resin is lighter and easier to be shaped than metals or the like. Therefore, with the construction of the preferred embodiment, by forming the displacement suppression members out of a material containing such a synthetic resin, it is possible to easily manufacture the displacement suppression members according to the shape and size of the arms to which the displacement suppression members are to be attached, respectively. Further, e.g. by employing a synthetic resin having a relatively high rigidity and a relatively high dimensional stability, it is possible to reliably obtain the above-mentioned action and advantageous effect of the hammer shank according to the first aspect of the present invention. It should be noted that the above-mentioned "material containing a synthetic resin" is intended to mean not only a composite material comprising a synthetic resin and a material other than the synthetic resin, but also a synthetic resin material comprising only a single synthetic resin or a plurality of synthetic resins.

More preferably, the displacement suppression members are phenol backers.

In general, the phenol backer (phenolic resin-impregnated paper) has a high rigidity and a high dimensional stability against dryness and wetness. Further, the phenol backer has is relatively inexpensive, and has a characteristic of high adhesiveness to wood. Therefore, with the construction of the preferred embodiment, by employing the phenol backer as the displacement suppression member and attaching the phenol backer onto the outer side surface of each arm e.g. by bonding, it is possible to easily realize a hammer capable of performing smooth and stable pivotal motion, at low costs.

To attain the above object, in a second aspect of the present invention, there is provided a method of manufacturing a hammer shank for a piano, comprising a preparation step of preparing a wooden hammer shank member which has one end thereof bifurcated into two arm parts continuously extending in facing and parallel relation to each other, and two plate-shaped displacement suppression members, an attachment step of attaching the displacement suppression members onto the hammer shank member by bonding the two displacement suppression members onto outer side surfaces of the respective two arm parts, and a cutting step of cutting the hammer shank member having the displacement suppression members attached thereon, at predetermined space intervals in a direction of extension of the arm parts along a direction orthogonal to the direction of extension, to thereby cut out a plurality of hammer shanks.

With the configuration of the method of manufacturing a hammer shank for a piano according to the second aspect of the present invention, first, the above-mentioned wooden hammer shank member and the two displacement suppression members are prepared. This wooden hammer shank member has the two bifurcated arm parts formed at one end thereof such that they continuously extend in facing and parallel relation to each other, and the displacement suppression members are each formed into a plate shape. Next, the two displacement suppression members are bonded onto the outer side surfaces of the respective two arm parts of the hammer shank member, whereby the displacement suppression members are attached onto the hammer shank member. Then, the hammer shank member are cut at predetermined space intervals in the direction of extension of the arm parts, along the direction orthogonal to the direction of extension, whereby a plurality of hammer shanks are cut out. This makes it possible to obtain a plurality of hammer shanks each having displacement suppression members attached on the outer side surfaces of the two arms, i.e. the same hammer shanks according to the first aspect of the present invention. Further, since the hammer shank member is cut after the two displacement suppression members have been attached onto the hammer shank member, it is possible to manufacture the hammer shanks more efficiently than in a case where displacement suppression members corresponding in size to each hammer shank are attached on a hammer shank-by-hammer shank basis.

Preferably, each of the displacement suppression members is a phenol backer.

With the construction of the preferred embodiment, since the phenol backer is employed as a displacement suppression member, it is possible to easily obtain the same hammer shank as the more preferred embodiment of the first aspect of the present invention.

The above and other objects, features, and advantages of the present invention will become more apparent from the following detailed description taken in conjunction with the accompanying drawings.

BRIEF DESCRIPTION OF THE DRAWINGS

FIGS. 6A and 6B are views showing tables of results of the dry/wet test.

DETAILED DESCRIPTION OF PREFERRED EMBODIMENTS

Figure 1:
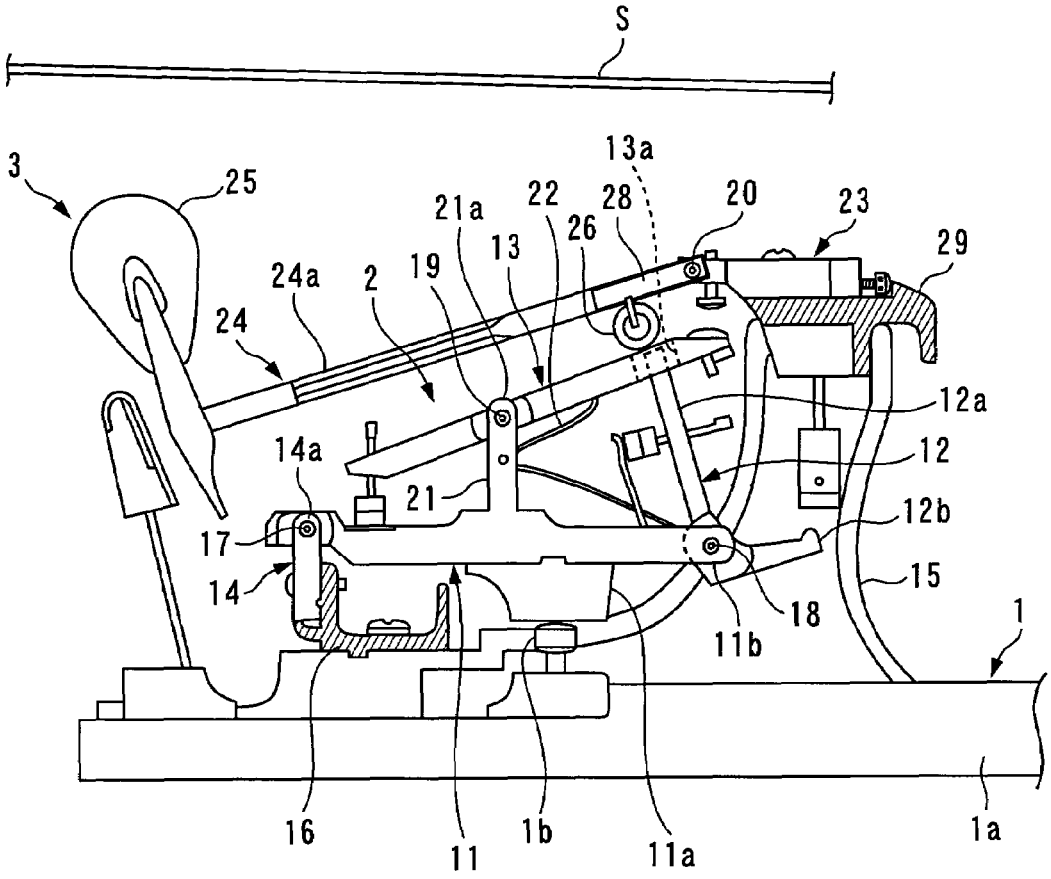
FIG. 1 is a side view of a keyboard, an action, and a hammer for a grand piano using a hammer shank according to an embodiment of the present invention, in a key-off state.

The invention will now be described in detail with reference to the drawings showing a preferred embodiment thereof. FIG. 1 shows a keyboard 1, an action 2, a hammer 3, etc. of a grand piano to which is applied a hammer shank for a piano, according to the embodiment of the present invention, in a key-off state.

The keyboard 1 is comprised of lots of keys 1*a* (only one of which is shown) arranged in a longitudinal direction of the grand piano. Each key 1*a* extends in a front-rear direction (the left-right direction as viewed in FIG. 1), and is supported in a manner pivotally movable about a balance pin erected on a keyframe on a keybed (none of which are shown).

The action 2 is disposed above the rear part of the keyboard 1, and includes a wippen 11, a jack 12, a repetition lever 13, etc. provided for each of the keys 1*a*. The wippen 11 extends in the front-rear direction, and has a rear end thereof supported by a wippen flange 14. The wippen flange 14 extends vertically, and is screwed to a wippen rail 16 extending between a plurality of brackets 15 (only one of which is shown in FIG. 1) arranged in the longitudinal direction of the grand piano in a manner spaced from each other. Further, the wippen flange 14 has an upper end thereof bifurcated into two left and right arms 14*a* and 14*a* (only a left one of which is shown in FIG. 1). The rear end of the wippen 11 is engaged between the two arms 14*a* and 14*a*, and a center pin 17 is horizontally passed through the two arms 14*a* and the wippen 11. Thus, the wippen 11 is supported by the wippen flange 14 in a manner pivotally movable about the center pin 17. Further, a heel section 11*a* projects downward from a central part of the wippen 11 in the front-rear direction. The wippen 11 is placed on a capstan screw 1*b* provided on a rear part of the key 1*a*, via the heel section 11*a*. The jack 12 is supported on a front end of the wippen 11.

The jack 12 is formed into an L-shape in side view by a vertically extending hammer push-up part 12*a* and a regulating button abutment part 12*b* extending forward from the lower end of the hammer push-up part 12*a* substantially at right angles thereto. The front end of the wippen 11 is bifurcated into two left and right arms 11*b* and 11*b* (only a left one of which is shown in FIG. 1). The jack 12 has its corner engaged between the two arms 11*b* and 11*b*, and a center pin 18 is horizontally passed through the two arms 11*b* and the jack 12. Thus, the jack 12 is supported by the front end of the wippen 11 in a manner pivotally movable about the center pin 18. An upper end of the hammer push-up part 12*a* is engaged in a jack guide hole 13*a*, referred to hereinafter, of the repetition lever 13, and is opposed to a shank roller 26 with a slight space therebetween. Further, the jack 12 is urged in a returning direction (counterclockwise direction as viewed in FIG. 1) by a repetition spring 22, referred to hereinafter.

The repetition lever 13 obliquely extends upward in the front-rear direction, and is supported by a lever flange 21 projected upward from the central part of the wippen 11 in the front-rear direction. The lever flange 21 has an upper end thereof bifurcated into two left and right arms 21*a* and 21*a* (only a left one of which is shown in FIG. 1). A central part of the repetition lever 13 is engaged between the two arms 21*a* and 21*a*, and a center pin 19 is horizontally passed through the two arms 21*a* and the repetition lever 13. Thus, the repetition lever 13 is supported by the upper end of the lever flange 21 in a manner pivotally movable about the center pin 19. The repetition lever 13 is urged in a returning direction (counterclockwise direction as viewed in FIG. 1) by the repetition spring 22 attached to the lever flange 21. Further, the repetition lever 13 has the jack guide hole 13*a* formed to extend vertically through a front portion thereof, and the hammer 3 is placed on the repetition lever 13 via the shank roller 26 in contact with the repetition lever 13 at a location at or around the upper opening of the jack guide hole 13*a*.

Figure 2:
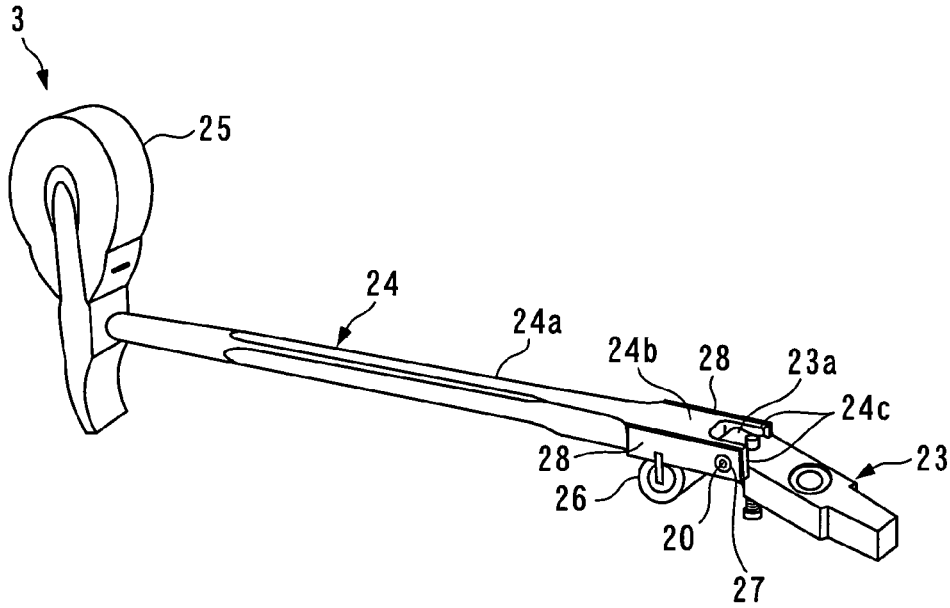
FIG. 2 is a perspective view of the hammer and a hammer shank flange.

FIG. 2 shows the hammer 3 and a shank flange 23 (flange) for supporting the hammer 3. The hammer 3 is comprised of a hammer shank 24 extending in the front-rear direction and a hammer head 25 mounted to a rear end of the hammer shank 24. The hammer head 25 is opposed to a string S (see FIG. 1) stretched above. The hammer shank 24 is formed of wood, such as hornbeam, and has a slender rod-like shank body 24*a*. The hammer shank body 24*a* has its fibers extending in the direction of length thereof, and has a front end thereof formed to have a larger width in the longitudinal direction of the grand piano than the other part of the shank body 24*a*. The upper and lower surfaces of the front end are formed as planes parallel with each other. It should be noted that in the following description, the large-width front end of the shank body 24*a* will be referred to as the "expanded-width part 24*b*".

Figure 3:
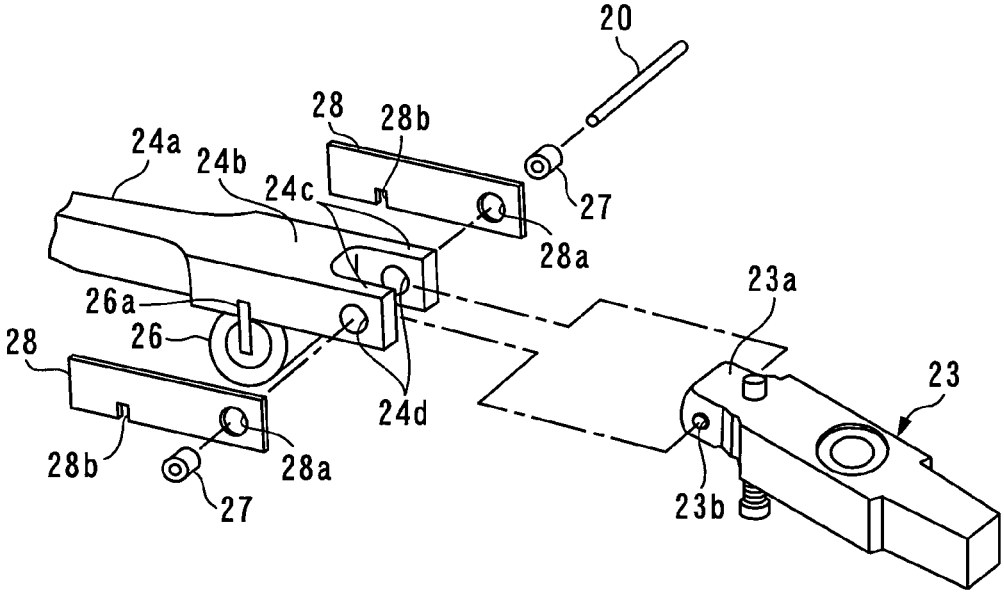
FIG. 3 is an exploded perspective view showing the hammer shank and the hammer shank flange in FIG. 2 on an enlarged scale.

The expanded-width part 24*b* of the shank body 24*a* is bifurcated into two left and right arms 24*c* and 24*c*. As shown in FIG. 3, the two arms 24*c* and 24*c* are opposed to each other in the longitudinal direction of the grand piano with a predetermined space therebetween, and extend forward parallel to each other. Each of the arms 24*c* is formed with a pin hole 24*d* extending therethrough in the longitudinal direction of the grand piano, and a hollow cylindrical bearing 27 formed of felt is fitted in the pin hole 24*d*. Further, the shank roller 26 is mounted to the lower surface of the expanded-width part 24*b* of the shank body 24*a* via a support member 26*a*. Further, phenol backers 28 and 28 (displacement suppression members) in the form of a thin plate and identical in shape and size are attached on the respective left and right outer side surfaces of the expanded-width part 24*b*.

Each of the phenol backers 28 is formed of paper impregnated with a phenolic resin, and has a high rigidity and a high dimensional stability against dryness and wetness. The phenol backer 28 has a predetermined thickness (e.g. 0.7 mm), and is formed into a rectangular shape which is long sideways (e.g. 6.3 mm high and 28 mm wide) which is substantially the same as the shape of the outer side surface of the expanded-width part 24*b* of the shank body 24*a*. Further, the phenol backer 28 has a predetermined portion formed with a through hole 28*a* through which the associated bearing 27 is fitted and a cutout 28*b* for engagement with the support member 26*a* of the shank roller 26. The phenol backers 28 formed as above are bonded on the respective opposite outer side surfaces of the expanded-width part 24*b* of the shank body 24*a* in a manner entirely covering these.

The shank flange 23 is formed of a synthetic resin, and screwed onto an upper surface of a hammer shank rail 29 (see FIG. 1) extending between the plurality of brackets 15. As shown in FIG. 3, the shank flange 23 extends in the front-rear direction, and is formed to have a rectangular shape in cross section. The shank flange 23 has a rear end thereof formed as an engaging part 23*a* having a slightly smaller width than a dimension between the arms 24*c* and 24*c* of the hammer shank 24 and projecting rearward for engagement between the arms 24*c* and 24*c*. The engaging part 23*a* is formed with a pin fitting hole 23*b* extending therethrough in the longitudinal direction of the grand piano. A center pin 20 is passed through bearings 27 and 27 and the pin fitting hole 23*b* between the bearings 27 and 27 with the engaging part 23*a* engaged between the arms 24*c* and 24*c* with a slight clearance from each of the inner surfaces of the respective arms 24*c* and 24*c*. The center pin 20 has its central part fixed in the pin fitting hole 23*b* and its opposite ends pivotally supported by the respective bearings 27 and 27. Thus, the hammer 3 is pivotally supported by the shank flange 23 via the center pin 20 integral with the shank flange 23.

With the above-described arrangement, as the key 1*a* is depressed in a key-off state illustrated in FIG. 1, the wippen 11 is pushed up via the capstan button 1*b* to pivotally move upward about the center pin 17, and the jack 12 and the repetition lever 13 also pivotally move upward about the respective center pins 18 and 19. At the same time, the hammer 3 is pushed up by the jack 12 via the shank roller 26 to pivotally move about the center pin 20 in the clockwise direction, as viewed in FIG. 1, while being guided by the arms 24*c* and 24*c* of the hammer shank 24 and the engaging part 23*a* of the shank flange 23. This causes the hammer 3 to strike the string S to thereby generate a piano tone.

Figure 4A:
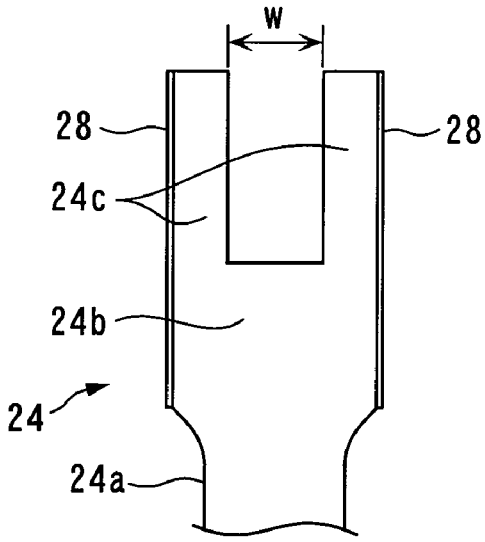
FIG. 4A is a plan view of an expanded-width part of the hammer shank according to the present embodiment, which is subjected to a dry/wet test.
Figure 4B:
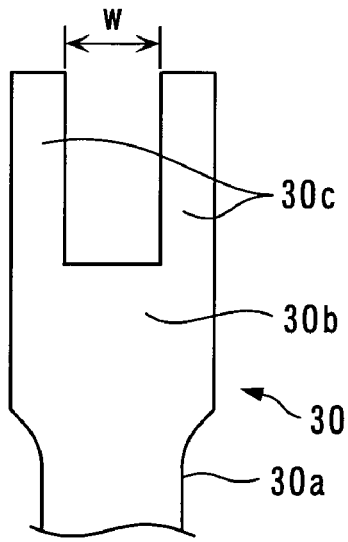
FIG. 4B PRIOR ART
FIG. 4B is a plan view of an expanded-width part of a hammer shank according to the prior art, which is subjected to a dry/wet test.

Next, a description will be given of a dry/wet test carried out on a hammer shank. FIGS. 4A and 4B show the expanded-width part of the hammer shank subjected to the dry/wet test. FIG. 4A shows the hammer shank 24 according to the embodiment, and the phenol backer 28 having a thickness of 0.7 mm is bonded on each of the left and right outer side surfaces of the expanded-width part 24*b* by a predetermined adhesive (e.g. an aqueous vinylurethane-based adhesive) in a manner entirely covering the associated outer side surface. On the other hand, FIG. 4B shows a generally used hammer shank 30 according to the prior art. Differently from the present example, the phenol backers 28 are not attached to an expanded-width part 30*b* of the hammer shank 30. Further, the shank body 24*a* of the hammer shank 24 and a shank body 30*a* of the hammer shank 30 are both made of hornbeam, and each have its fibers extending in the direction of the length thereof (i.e. a vertical direction as viewed in FIG. 4).

The hammer shank 24 according to the embodiment, constructed as above, and the hammer shank 30 according to the prior art were produced under normal conditions (e.g. a temperature of 20° C. and a humidity of 50%), and the following two types of dry/wet tests were carried out on the hammer shanks 24 and 30:

(1) Normal Conditions→Humidification→Drying

In this dry/wet test, first, the above-described hammer shanks 24 and 30 were left in a test chamber for four days under predetermined humidifying conditions (a temperature of 25° C. and a humidity of 85%). Then, the hammer shanks 24 and 30 after humidification are let standing under predetermined drying conditions (a temperature of 45° C. and a humidity of 10±5%) for four days.

(2) Normal Conditions→Drying→Humidification

This dry/wet test is distinguished from the above dry/wet test (1) only in that the order of humidification and drying is reversed, and the other conditions are the same as in the dry/wet test (1).

In either of the dry/wet tests (1) and (2), 20 pieces of each of the hammer shank 24 according to the embodiment and the hammer shank 30 according to the prior art were prepared, and the dimension between the arms 24*c* and 24*c* of each hammer shank 24 and that between the arms 30*c* and 30*c* of each hammer shank 30 (the dimensions will be referred to as the "arm-to-arm dimension W") were measured under the normal conditions before the test, after completion of the humidification, and after completion of the drying. FIGS. 6A and 6B show results obtained from the respective dry/wet tests (1) and (2). It should be noted that numerical values as the test results are average values of arm-to-arm dimensions W measured under the normal conditions, after the humidification, and after the drying, and respective average values of the difference between the dimensions of arm-to-arm dimension W measured before and after the humidification and that between the dimensions of the same measured before and after the drying. Parenthesized numerical values indicate respective standard deviation values.

Figure 5A:
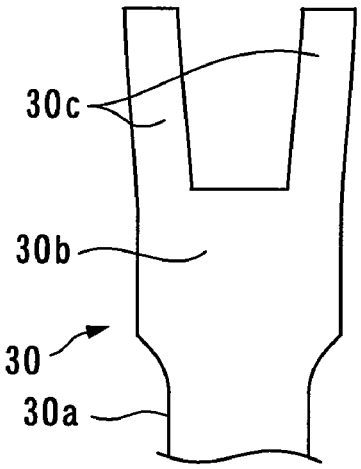
FIGS. 5A and 5B are views useful in explaining deformation of two arms after humidification and drying in the dry/wet test.
Figure 5B:
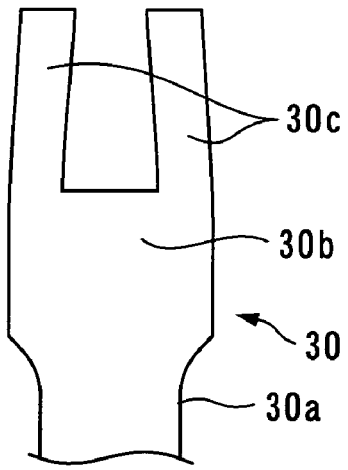

As shown in FIGS. 6A and 6B, in the case of the hammer shank 30 according to the prior art, the difference between the dimensions of the arm-to-arm dimensions W measured before and after the humidification and that between the dimensions of the same measured before and after the drying in the dry/wet test (1) were 0.13 mm and −0.23 mm, respectively, while the difference between the dimensions of the arm-to-arm dimensions W measured before and after the drying and that between dimensions of the same measured before and after the humidification in the dry/wet test (2) were −0.11 mm and 0.23 mm, respectively. It should be noted that in the case of the hammer shank 30, as shown in FIGS. 5A and 5B, after the humidification, there was perceived a change in which the two arms 30*c* and 30*c* were widened to increase the arm-to-arm dimension W, whereas after the drying, there was perceived a change in which the two arms 30*c* and 30*c* were narrowed to reduce the arm-to-arm dimension W.

In contrast, in the case of the hammer shank 24 according to the embodiment, the difference between the dimensions of the arm-to-arm dimensions W measured before and after the humidification and that between the dimensions of the same measured before and after the drying in the dry/wet test (1) were 0.05 mm and 0.00 mm, respectively, while the difference between the dimensions of the arm-to-arm dimensions W measured before and after the drying and that between the dimensions of the same measured before and after the humidification in the dry/wet test (2) were −0.02 mm and 0.09 mm, respectively. Further, the standard deviation values of the respective measured values were both very small ones of not more than 0.06, which means that variations between the hammer shanks 24 as test pieces are small. As can be understood from the above-described results, by attaching the phenol backers 28 and 28 onto the respective opposite outer side surfaces of the expanded-width part 24*b*, it is possible to suppress an increase in the dimension between the arms 24*c* and 24*c* to less than one half of the increase in the arm-to-arm dimension W of the conventional hammer shank 30 under the wet environment, and to suppress reduction in the dimension between the arms 24*c* and 24*c* to less than one fifth of the reduction in the arm-to-arm dimension W of the conventional hammer shank 30 under the dry environment.

As described above, according to the present embodiment, the phenol backers 28 and 28 are bonded on the respective opposite outer side surfaces of the expanded-width part 24*b* of the hammer shank 24, and function as splints, so to say, for the arms 24*c* and 24*c* to restrain these. As a consequence, displacement of the arms 24*c* and 24*c* in a direction in which they face each other is suppressed. This makes it possible to stably maintain the dimension between the arms 24*c* and 24*c* to thereby maintain the size of the clearance between each of the inner side surfaces of the respective arms 24*c* and 24*c* and the shank flange 23, so that occurrence of a stick due to dryness or wetness, and lateral deflection or wobbling of the hammer 3 during its pivotal motion can be prevented. Therefore, smooth and stable operation of the hammer 3 can be ensured irrespective of whether it is dry or wet. Further, since the phenol backer 28 is not only relatively inexpensive, but also has a characteristic of high adhesiveness to wood, it is possible to easily attach the phenol backers 28 and 28 to the hammer shank 24. Therefore, a hammer 3 which is capable of smooth and stable pivotal motion can easily be realized at low costs.

Further, since the phenol backers 28 and 28 can be additionally attached to a hammer shank in an existing grand piano, it is possible to ensure smooth and stable pivotal motion of each hammer in the existing grand piano as well.

Figures 7A, 7B, 7C:
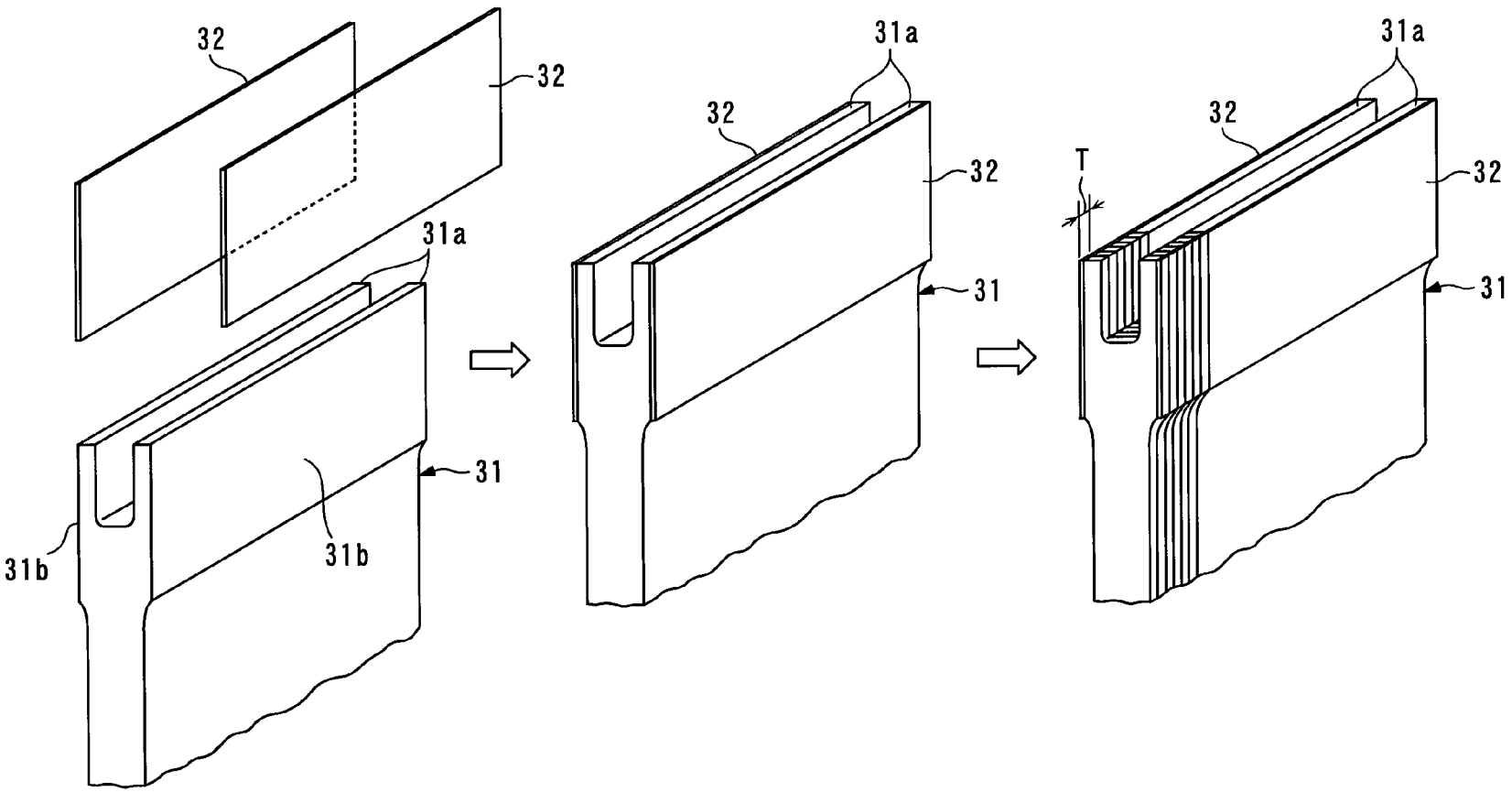
FIGS. 7A, 7B and 7C are views useful in explaining the method of manufacturing a hammer shank.

Next, a description will be given of a method of manufacturing the hammer shanks. FIGS. 7A, 7B and 7C show part of steps of the method of manufacturing the hammer shanks, in the order of the procedure. As shown in FIG. 7A, first, a wooden hammer shank member 31 and a pair of phenol backer plates 32 (displacement suppression members) are prepared (preparation step). Specifically, e.g. by cutting a plate of a predetermined shape and a predetermined size, the hammer shank member 31 is prepared which has one end thereof bifurcated into two arm parts 31*a* and 31*a* continuously extending parallel to each other in facing relation. Further, the two phenol backer plates 32 are prepared each of which is formed by a phenol backer having a predetermined thickness (e.g. 0.7 mm) and identical in shape and size to a flat surface 31*b* of the hammer shank member 31 including the outer side surface of the arm part 31*a*.

Next, the same adhesive as mentioned hereinbefore is applied to the opposite flat surfaces 31*b* and 31*b* of the hammer shank member 31, and then the phenol backer plates 32 and 32 are bonded onto the respective flat surfaces 31*b* and 31*b* (attachment step). Thus, as shown in FIG. 7B, the two phenol backer plates 32 and 32 are securely attached on the respective flat surfaces 31*b* and 31*b* of the hammer shank member 31. Then, as shown in FIG. 7C, the hammer shank member 31 having the phenol backer plates 32 and 32 attached thereon is cut at predetermined space intervals of T (e.g. 6.3 mm) in a direction of extension of the arm parts 31*a* e.g. by crosscut sawing the hammer shank member 31 along a direction orthogonal to the direction of extension of the arms 31*a* (cutting step). This cuts out a plurality of hammer shanks (hereinafter referred to as "half-finished hammer shanks") having approximately the same shape as the hammer shank having the above-described phenol backers 28 attached thereon. Thereafter, the half-finished hammer shank is cut or machined, as required, whereby the above-described hammer shank 24, i.e. the hammer shank 24 having the phenol backers 28 and 28 attached on the respective outer side surfaces of the expanded-width part 24*b* is obtained.

According to the method of manufacturing the hammer shanks, the two phenol backer plates 32 and 32 are attached to the hammer shank member 31, and then the hammer shank member 31 is cut. Therefore, it is possible to manufacture the hammer shanks 24 each having the phenol backers 28 and 28, more efficiently than in a case where the phenol backers 28 and 28 are attached onto each shank body 24*a*. Further, since the other steps than the step of attaching the two phenol backer plates 32 and 32 onto the hammer shank member 31 are the same as the generally employed conventional method of manufacturing hammer shanks, a conventional manufacturing line can be utilized for manufacturing the hammer shanks 24, which makes it possible to suppress an increase in manufacturing costs.

It should be noted that the present invention is not limited to the above-described embodiment, but can be practiced in various forms. For example, although in the present embodiment, the phenol backers 28 are used as displacement suppression members for preventing displacement of the arms 24*c* and 24*c* of the hammer shank 24, members containing other suitable synthetic resin having a relatively high rigidity and a relatively high dimensional stability may be employed in place of the phenol backers 28. Further, some phenol backers have a so-called anisotropic property that rigidity is different depending on the direction, and hence when such a phenol backer is used as the phenol backer 28, it is preferable to bond the phenol backer 28 such that a direction in which rigidity thereof is higher matches the direction of length of the hammer shank 24. Furthermore, although in the present embodiment, the phenol backer 28 is entirely bonded onto each outer side surface of the expanded-width part 24*b* of the hammer shank 24, the shape, size, and bonding position of a phenol backer to be bonded may be changed as deemed appropriate, insofar as change in the dimension between the arms 24*c* and 24*c* due to dryness and wetness can be suppressed. In addition, the phenol backer 28 may be attached by another suitable mounting method than bonding. Further, the construction of the hammer shank 24 in the present embodiment is shown only by way of example, and various changes and modifications can be made, as required, without departing from the spirit and scope of the present invention.

It is further understood by those skilled in the art that the foregoing are preferred embodiments of the invention, and that various changes and modifications may be made without departing from the spirit and scope thereof.

What is claimed is:

1. A hammer shank for a piano, which is supported by a flange and pivotally moves in accordance with key depression, comprising:

a shank body that is formed of wood;

two bifurcated arms that are formed on one end of said shank body in a manner extending in facing and parallel relation to each other along respective opposite sides of the flange, and are pivotally supported by the flange; and displacement suppression members that are attached on outer side surfaces of said respective two arms so as to suppress displacement of said two arms in a direction in which said arms face each other.

2. A hammer shank as claimed in claim 1, wherein each of said displacement suppression members is formed of a material containing a predetermined synthetic resin.

3. A hammer shank as claimed in claim 2, wherein said displacement suppression members are phenol backers.

4. A method of manufacturing a hammer shank for a piano, comprising:

a preparation step of preparing a wooden hammer shank member which has one end thereof bifurcated into two arm parts continuously extending in facing and parallel relation to each other, and two plate-shaped displacement suppression members;

an attachment step of attaching the displacement suppression members onto the hammer shank member by bonding the two displacement suppression members onto outer side surfaces of the respective two arm parts; and a cutting step of cutting the hammer shank member having the displacement suppression members attached thereon, at predetermined space intervals in a direction of extension of the arm parts along a direction orthogonal to the direction of extension, to thereby cut out a plurality of hammer shanks.

5. A method as claimed in claim 4, wherein each of the displacement suppression members is a phenol backer.

* * * * *